United States Patent [19]

Wahl

[11] 3,939,850

[45] Feb. 24, 1976

[54] HAIR COMB AND DRYER DEVICE

[75] Inventor: John F. Wahl, Sterling, Ill.

[73] Assignee: Wahl Clipper Corporation, Sterling, Ill.

[22] Filed: Dec. 10, 1973

[21] Appl. No.: 422,991

[52] U.S. Cl. ..... 132/11 R; 34/96
[51] Int. Cl.[2] ..... A45D 24/00
[58] Field of Search ..... 132/11, 137, 103, 118, 132/139, 143, 150; 34/96–98

[56] References Cited

UNITED STATES PATENTS

| | | | |
|---|---|---|---|
| 997 | 11/1838 | Sanford | 132/139 |
| 2,576,368 | 11/1951 | Steiner | 132/11 R |
| 3,066,683 | 12/1962 | Pace | 132/11 A |
| 3,730,190 | 5/1973 | Ford | 132/11 R |
| 3,837,581 | 9/1974 | Orsoff | 34/97 |

*Primary Examiner*—G. E. McNeill
*Attorney, Agent, or Firm*—Carl C. Batz

[57] ABSTRACT

A hair comb and dryer device which has an elongated casing enclosing a fan, motor and heating device, and which serves as a handle, and a comb structure having a comb element in a plane transverse of the longitudinal axis of the casing, so enabling the device to be used in the manner of a rake. The device includes a passageway having baffles arranged to focus the warm air moving through the device toward the hair just as the hair has moved through the comb.

6 Claims, 4 Drawing Figures

HAIR COMB AND DRYER DEVICE

This invention pertains to a hair comb and dryer device, and more particularly to such a device which is effective for discharging drying air onto hair immediately after the hair has been straightened or untangled by the comb.

BACKGROUND

Many devices for combing and drying hair have previously been provided but these devices are usually lacking with respect either to the convenience of use or effectiveness in performing the drying function. In most of such devices the drying air is delivered lengthwise of the base of the comb to an area in the vicinity of the hair being combed, and with this arrangement the drying air comes into contact with the hair before it passes the teeth of the comb making the removal of tangling more difficult. It is an object of the present invention to provide a comb and dryer device which delivers drying air only at a point the hair has just passed through the comb and where the hair is under slight tension due to being combed. Another object is to provide such a device where the comb is arranged transversely with the body or handle of the device so that the operator may move the device through the hair in a manner of a rake. Still another object is to provide such a device in which air is circulated through the body or handle and through a passageway for directing the air along the face of the comb and into the hair as it emerges from the comb. Other more specific objects and advantages will become apparent as this specification proceeds.

DETAILED DESCRIPTION

One embodiment of the invention is illustrated in the accompanying drawings in which.

Figure 1:
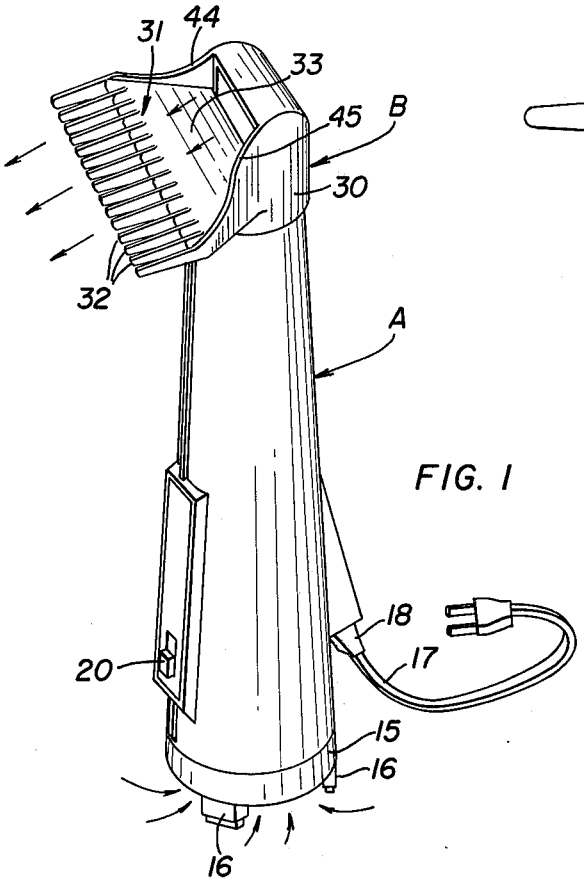
FIG. 1 is a view in perspective of the improved device.

As illustrated, the improved device includes an elongated casing A which serves as a handle, and a comb structure B at the top end of the casing.

The casing A is generally cylindrical, its longitudinal axis being shown in a vertical direction. The casing may be molded in two parts and these two parts assembled together with the heating element 10, the motor 11 and the fan 12 secured inside the casing, the arrangment being such that the fan 12 when rotated by motor 10, draws air into the casing through the inlet opening 13 at the bottom of the casing, passes the air over the motor and through heating element 10 and out of the casing through the top opening 14.

The casing A is fitted at its bottom end into a base structure 15 having legs 16 on which the device may be supported on a dressing table or like supporting surface. An electric cord 17 is provided to energize the heating coil and motor, and this cord is led into the casing in an inclined manner to the fitting 18. A switch 20 is located on the side of the casing for convenience in starting the device in operation.

The comb structure B has a lower cylindrical band portion 30 which fits over the cylindrical top of the casing A. The structure is held in place by this frictional engagement, but may be turned with respect to the casing or may be removed simply by pulling the structure up axially of the casing.

Figure 2:
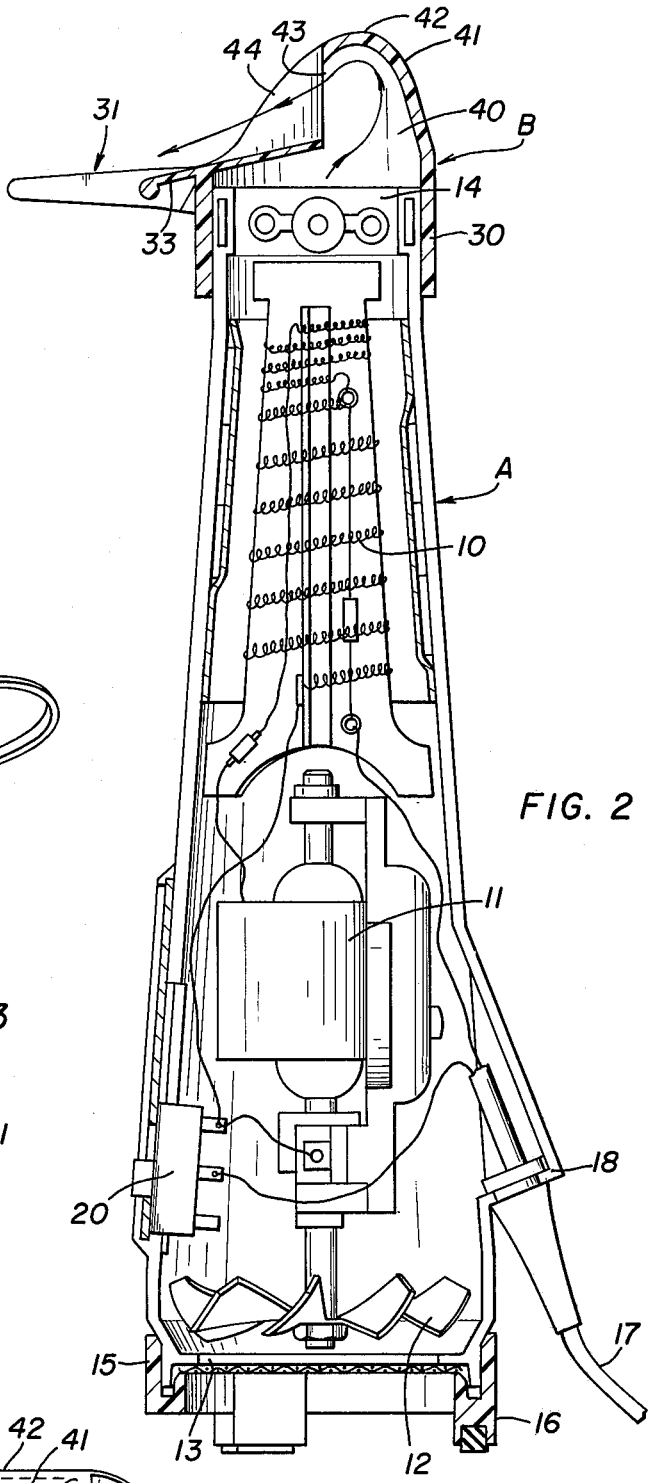
FIG. 2 is a longitudinal sectional view exposing the fan, motor and heating element contained within the casing or handle of the device.
Figure 3:
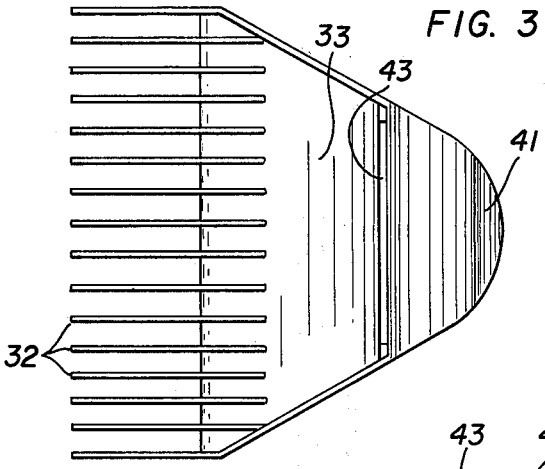
FIG. 3 is a plan view of the comb structure.
Figure 4:
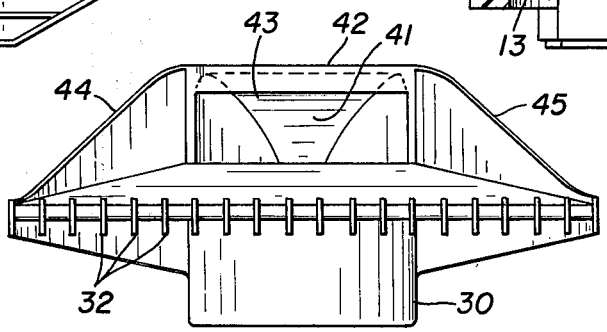
FIG. 4 is a front elevational view of the comb structure.

Extending forwardly from band portion 30 is the comb 31. This comb extends in a plane transverse with the longitudinal axis of the casing. As shown more clearly in FIG. 2 the comb is in a plane substantially at 90° with the casing axis. The comb includes a row of spaced teeth 32 which extend laterally from the comb base 33. The comb base 33 joins the edges of the band portion 30 and forms a baffle which on its underside serves to guide the rising air to the backside of the passageway 40 within structure B, and on its upperside to provide a surface which guides the air toward the teeth of the comb. On the backside of the passageway 40 within structure B is the inclined wall 41 which, as shown particularly in FIG. 2, is arranged to turn the direction of the rising air toward the front of the structure. This wall reaches its highest point at the place designated by the character 42, and from this place forwardly is inclined in a downward direction, so as to turn the air moving through the device in a direction which is inclined downwardly, to cause the plane of the moving air to intersect the plane of the comb.

The forward end of the wall 41 forms the top edge of the air discharge opening 43, and the back edge of the baffle 33 forms the lower edge of this opening. It will be noted that the air rising from the casing A moves upwardly through the passageway 40 to points above or beyond the plane of the comb 31 and then is turned toward the comb and discharged from opening which is above or beyond the plane of the comb and from which the air is directed along the top face of the comb and in the direction in which the teeth 32 extend. The plane of the opening 43 is preferably parallel with the axis of the casing A. Side portions 44 and 45 join the edges of the opening with the comb base 33 at their lower edges, and these side portions together with the comb base provide a channel through which the air may move from the discharge opening toward the teeth 32.

In the use of the device the operator grasps the casing A as a handle and turns the switch 20 to energize the heating element and start the fan, and then proceeds to move the comb through her hair in a manner of a rake, pulling the comb through her hair starting near the scalp and moving toward the end of the hair. This serves to produce a slight tension in the hair between the scalp and the comb and the device very effectively delivers a strong current of warm air out of the discharge opening 43 against the hair at the top side of the comb just as the teeth of the comb have untangled or straightened the hair and while it is under slight tension as above mentioned. Any discharge of warm air to the yet unstraightened hair is in this way avoided and the air is most effectively utilized in drying the hair where drying is needed.

When the device is not being used by hand as above explained the device may be rested on its feet 16 on top of the dressing table and if desired the fan left to run so that the device delivers a stream of warm air in a general direction toward the hair being dried. In such case the air proceeds between the legs 16 and the dressing table, upwardly through the casing and through passageway 40 of the comb structure where it is turned to move in a lateral or horizontal path, toward the hair of the operator.

I believe it to be an advantage that as the warm air moves through the comb structure it is guided by the baffle formed by the comb base 33 toward the back of the passageway 40, and further that the air so guided toward the back of the passageway is again turned by the inclined wall 41 of the passageway to a direction which is downwardly inclined toward the teeth 32 of the comb, in a plane which intersects the plane of the comb. The direction of the air as it traverses passageway 40 is diagrammatically illustrated by the arrows 45 in FIG. 2 of the drawing. By this arrangment of baffles in the passageway through the comb structure the warm air is confined and channeled in a way to produce most effective contact with the hair to dry the hair most efficiently.

Also I regard it as an advantage that the operator of the improved device may hold the device by grasping the casing as a handle and with the handle more or less in a vertical position use the instrument as a rake, passing the comb from near the scalp downwardly to the ends of the hair. In a similar manner the operator may move the casing or handle A axially toward the right or toward the left in a raking kind of motion, and so dry the hair using the warm air currents delivered by the device in a most efficient way.

While I have illustrated and described in detail only one embodiment of my improved comb and hair drying device, it will be apparent to those skilled in the art that this invention may take many and different forms, and this application is intended to embrace all such forms of the invention falling within the spirit of the invention and within the scope of the appended claims.

I claim:

1. In a hair comb and drying device, an elongated tubular casing, means contained within said casing for projecting air therethrough and discharging air through an outlet at one end thereof, and a comb structure at said one end of said casing including a row of teeth extending in a plane which makes an angle of substantially 90° with the axis of said casing, said structure having an internal passageway connecting with said outlet and leading to an air discharge opening which is above the transverse plane of said row of teeth, said discharge opening facing toward said row of teeth, whereby upon the passing of air through said casing and through said passageway the air is directed along the top of said row of teeth.

2. A device as set forth in claim 1 wherein said comb structure contains a baffle for directing air entering said passageway toward the backside of said structure opposite said row of teeth.

3. A device as set forth in claim 2 wherein the end of said baffle forms a lower edge of said discharge opening.

4. A device as set forth in claim 1 wherein the top of said passageway is a curved surface extending downwardly toward the top edge of said discharge opening.

5. A device as set forth in claim 1 in which said casing is cylindrical and wherein said comb structure has a lower cylindrical band which frictionally engages the outside of said end of said casing.

6. A device as set forth in claim 1 wherein there is contained within said casing a heating element and wherein said means includes a fan and motor for driving said fan, said fan being positioned to drive air across said heating element and into said passageway of said comb structure.

* * * * *